US007090536B2

(12) United States Patent
Choy

(10) Patent No.: US 7,090,536 B2
(45) Date of Patent: Aug. 15, 2006

(54) IC CARD CONNECTOR WITH ANTI-MISMATING DEVICE

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,261

(22) Filed: Nov. 30, 2004

(65) Prior Publication Data

US 2006/0116025 A1 Jun. 1, 2006

(51) Int. Cl.
*H01R 24/00* (2006.01)

(52) U.S. Cl. ..... 439/630

(58) Field of Classification Search ..... 439/630, 439/64, 541.5, 677
See application file for complete search history.

(56) References Cited

U.S. PATENT DOCUMENTS 6,319,070 B1 * 11/2001 Tan ..... 439/680
6,402,529 B1 * 6/2002 Saito et al. ..... 439/74
6,666,724 B1 * 12/2003 Lwee ..... 439/630

* cited by examiner

*Primary Examiner*—Javaid H. Nasri
(74) *Attorney, Agent, or Firm*—Wei Te Chung

(57) ABSTRACT

An electrical connector includes an insulative housing assembly equipped with two sets of contacts adapted to be coupled to two different type cards which are mutually exclusively received in at least partially a common space in the housing. A device moveably disposed in the common space functions to not only guide correct insertion of the cards into the correct position/space but also prevent incorrect insertion of the cards into the incorrect position/space.

6 Claims, 14 Drawing Sheets

IC CARD CONNECTOR WITH ANTI-MISMATING DEVICE

The invention relates to IC card connectors, and particularly to the IC card connector equipped with anti-mismating means for assuring the different size/type cards will be correctly received in the correct positions through the same entrance opening.

It is popular to provide one single IC card connector with different sets of terminals at different locations to engage the different size/type IC cards which mutually exclusively enter the common receiving space defined in said IC card via the same entrance opening. Understandably, the housing of the IC card is provided some key/keyway in the guiding channels to guidably retain the inserted cards in position; anyhow, sometimes a small dimensioned card may be inadvertently inserted into the entrance opening in an improper tilted manner that it may be uncontrollably led to an incorrect position, thus either damaging the terminals or being damaged by the terminals. The safest way is to provide different spaces and/or different entrance opening in the IC connector, while it will increase the total thickness thereof that is opposite to the miniaturization trend. Accordingly, it is desired to provide a safe structure for the IC card connector to regulate different cards' insertion. Some attempts might have been considered, including having a set of terminal module being moveably arranged relative to the other, either linearly or rotatably, while such attempts are so complicated that either no space in the notebook computer to compliantly allow such a movement, or reliability is doubtful.

On the other hand, in the modular jack connector there are several different workable approaches to prevent a small plug from incorrectly being inserted into a large sized modular jack which is fit for a large plug, for example, U.S. Pat. Nos. 6,257,935 and 6,319,070. Anyhow, such application refers to the prevention in the connector having only one set of terminals which is fit for the large plug. There is no teaching regarding one connector housing is provided with two different sets of terminals in the common space for mutually exclusive coupling to two different sized IC cards only.

Therefore, an object of the invention is to provide an IC card connector, having a common receiving entrance and two different sets of terminals thereof, with an anti-mismating device for mutually exclusively coupling to two different size/type IC cards correctly.

Yet, another object of the invention is to provide an IC card connector with a restriction device which is capable of retaining a small sized card in position when the small sized card is inserted into the common receiving space while not obstructing insertion of a large sized card when the large sized card is inserted into the common receiving space.

SUMMARY OF THE INVENTION

According to an aspect of the invention, an electrical connector includes an insulative housing assembly equipped with two sets of contacts adapted to be coupled to two different type cards which are mutually exclusively received in a common space in the housing. A device moveably disposed in the common space functions to not only guide correct insertion of the cards into the correct position/space but also prevent incorrect insertion of the cards into the incorrect position/space.

BRIEF DESCRIPTION FOT HE DRAWINGS

DETAILED DESCIRPTION OF THE PREFERRED EMBODIMENT

Figure 1:
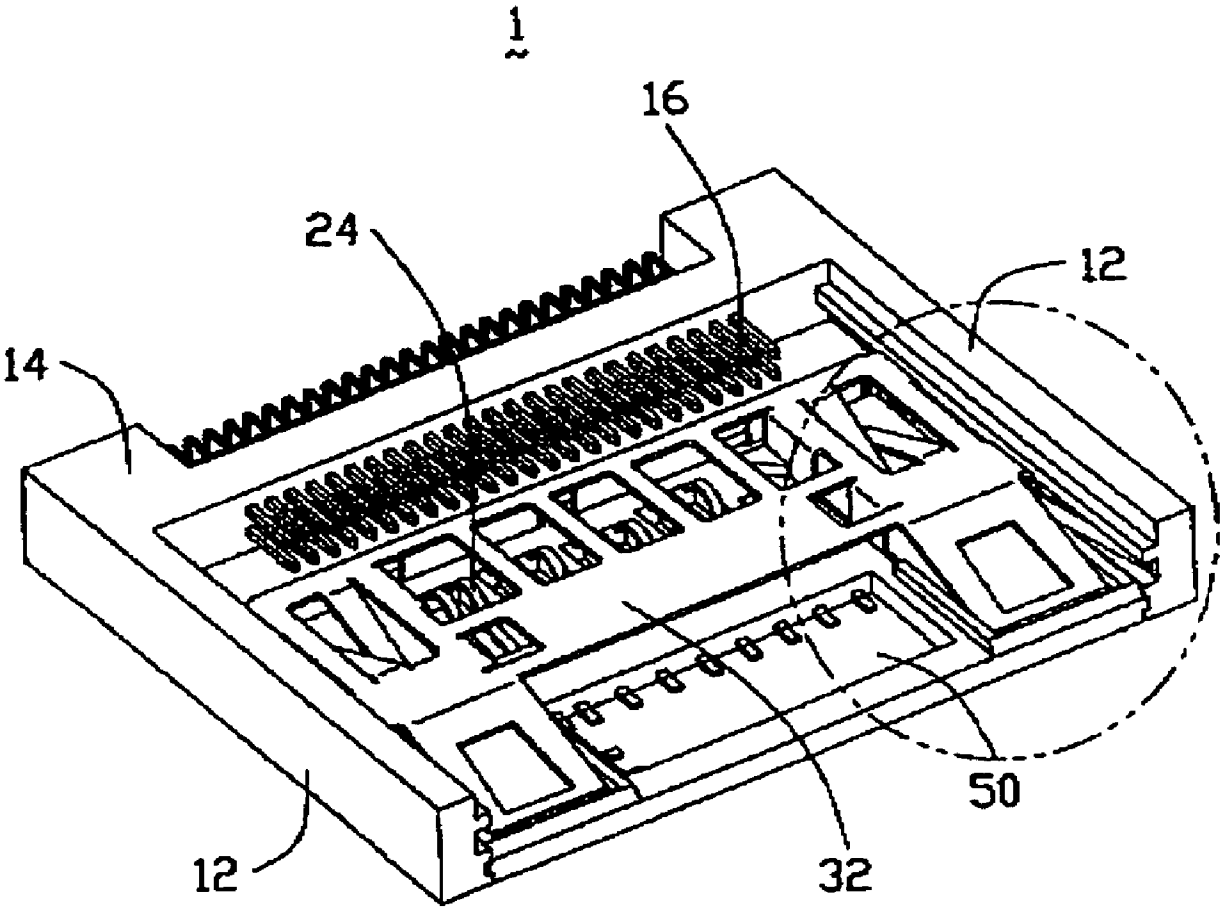
FIG. 1 is an assembled perspective view of an electrical connector according to the instant invention.
Figure 2:
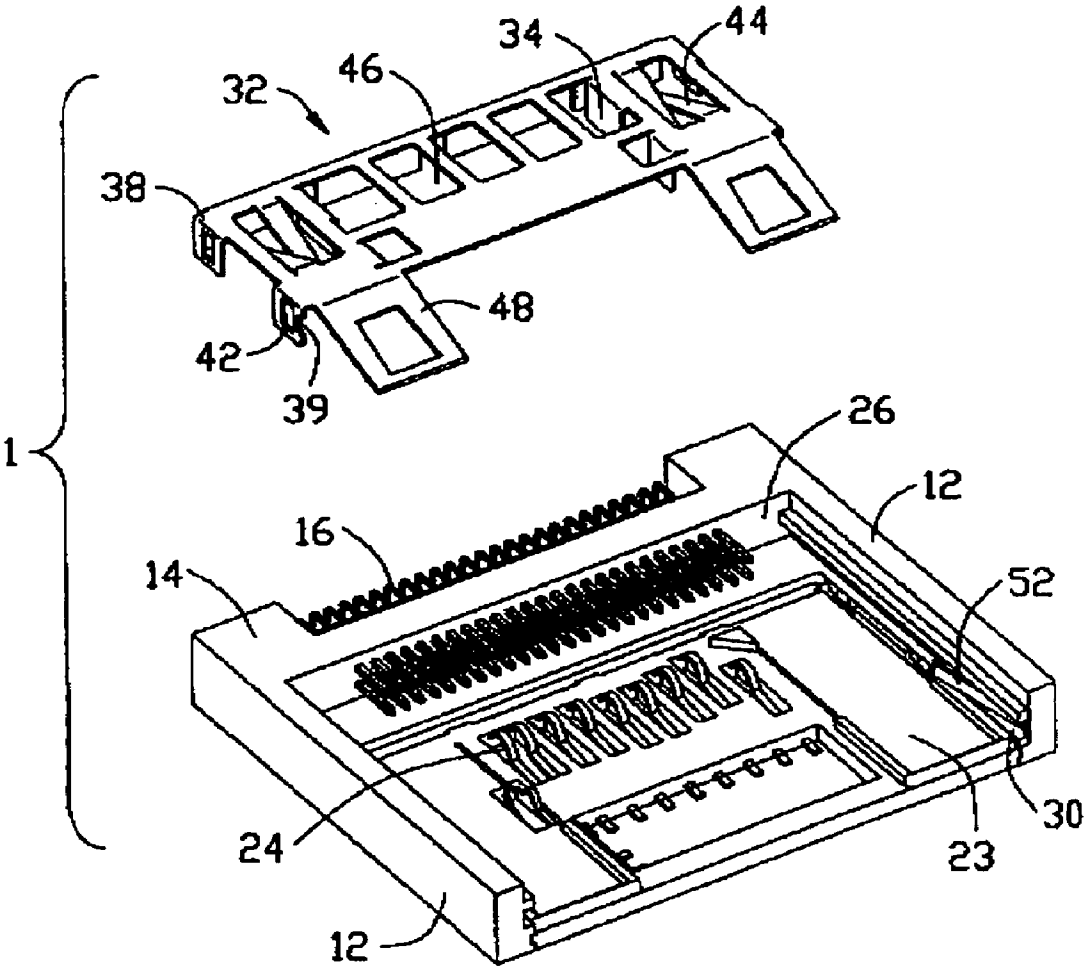
FIG. 2 is a partially exploded perspective view of the connector of FIG. 1 with the moveable plate detached from the housing
Figure 3:
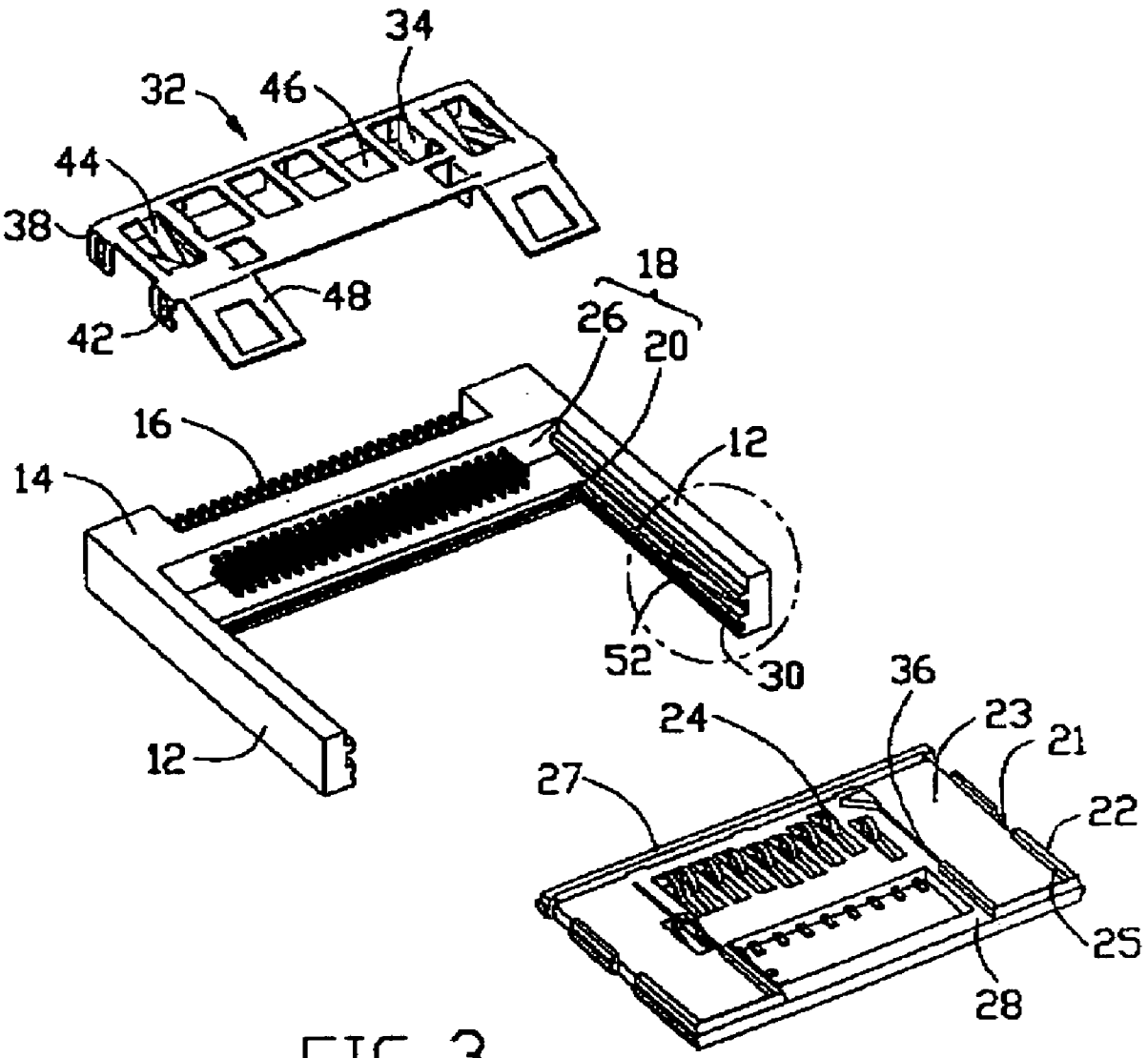
FIG. 3 is a further partially exploded perspective view of the connector of FIG. 2 with both he moveable plate and the contact module disassembled from the housing.
Figure 4:
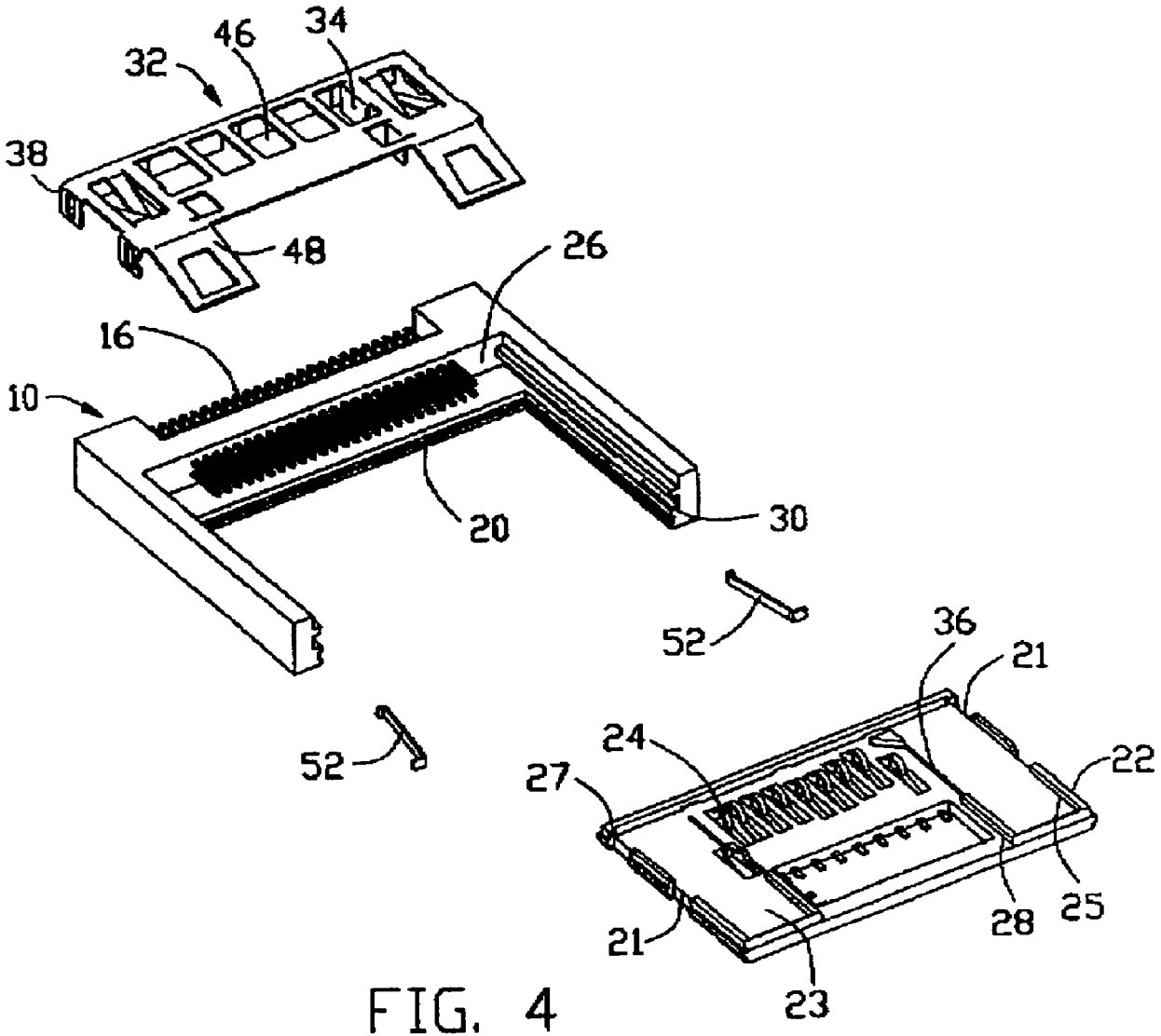
FIG. 4 is a further partially exploded perspective view of the connector of FIG. 3 with the moveable stopper tang disassembled from the housing.
Figure 5:
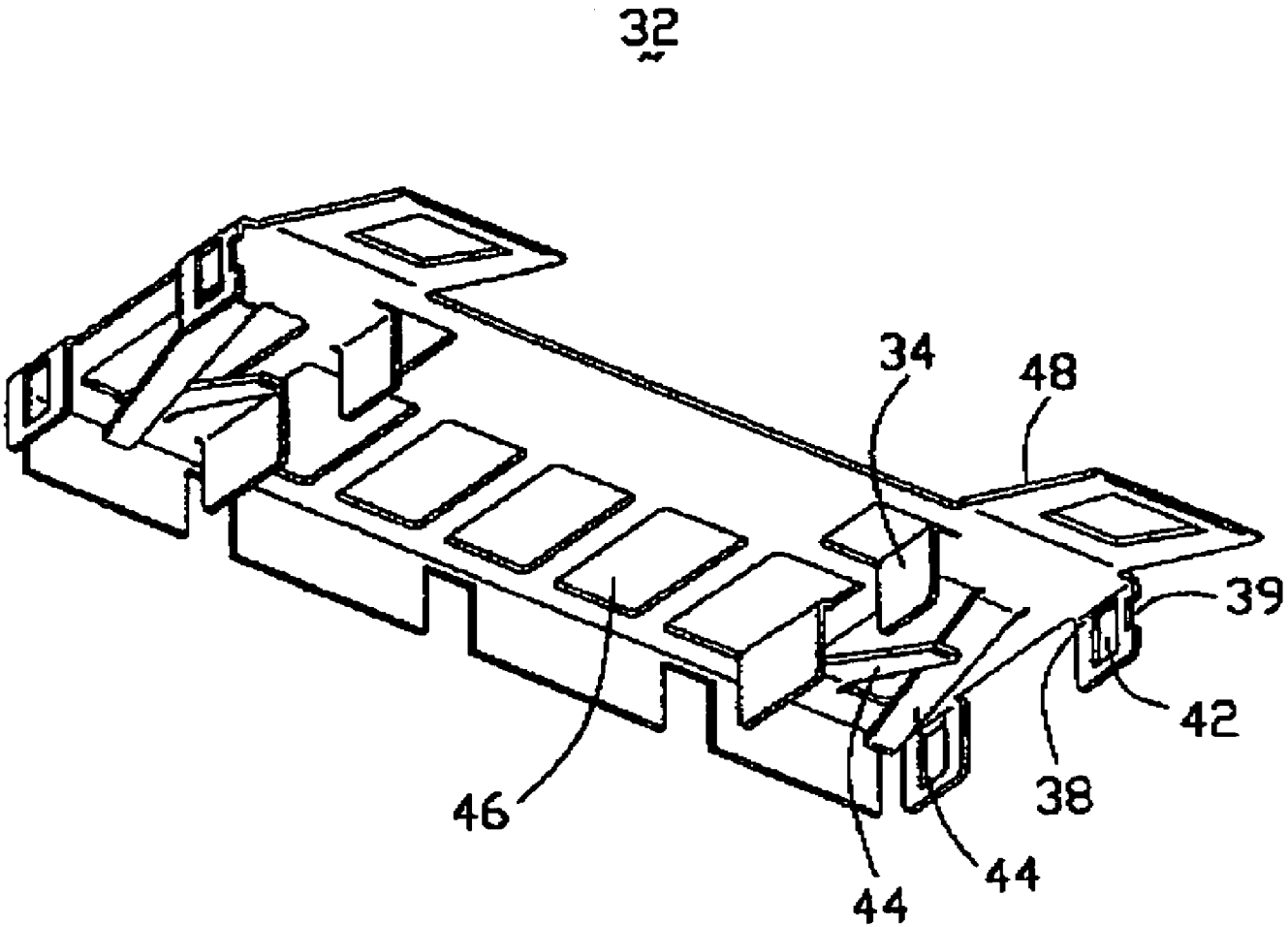
FIG. 5 is a perspective view of the moveable plate of the connector of FIG. 1.
Figure 6:
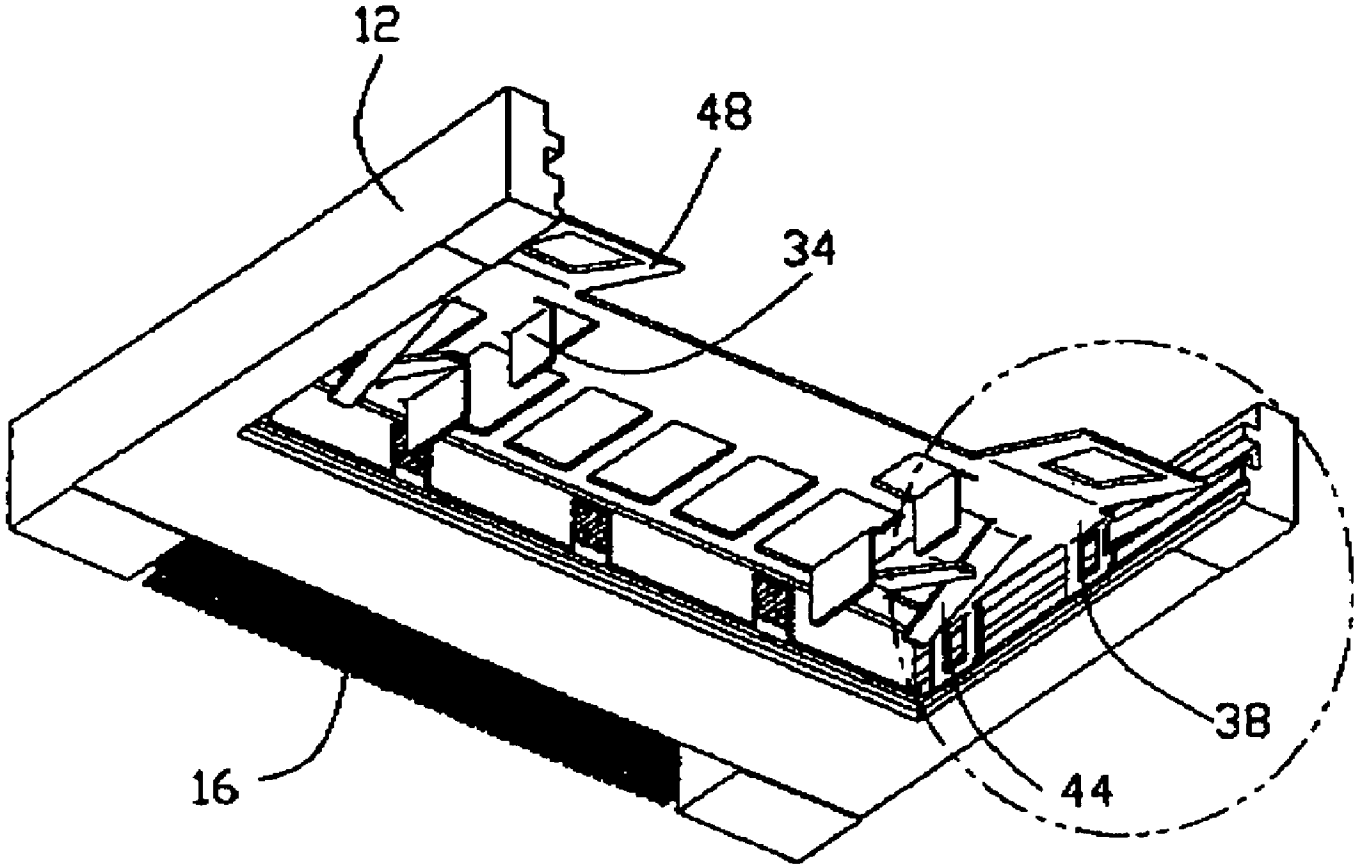
FIG. 6 is a bottom perspective view of the connector of FIG. 1 without the contact module to show how the stopper tang latches the moveable plate.
Figure 7:
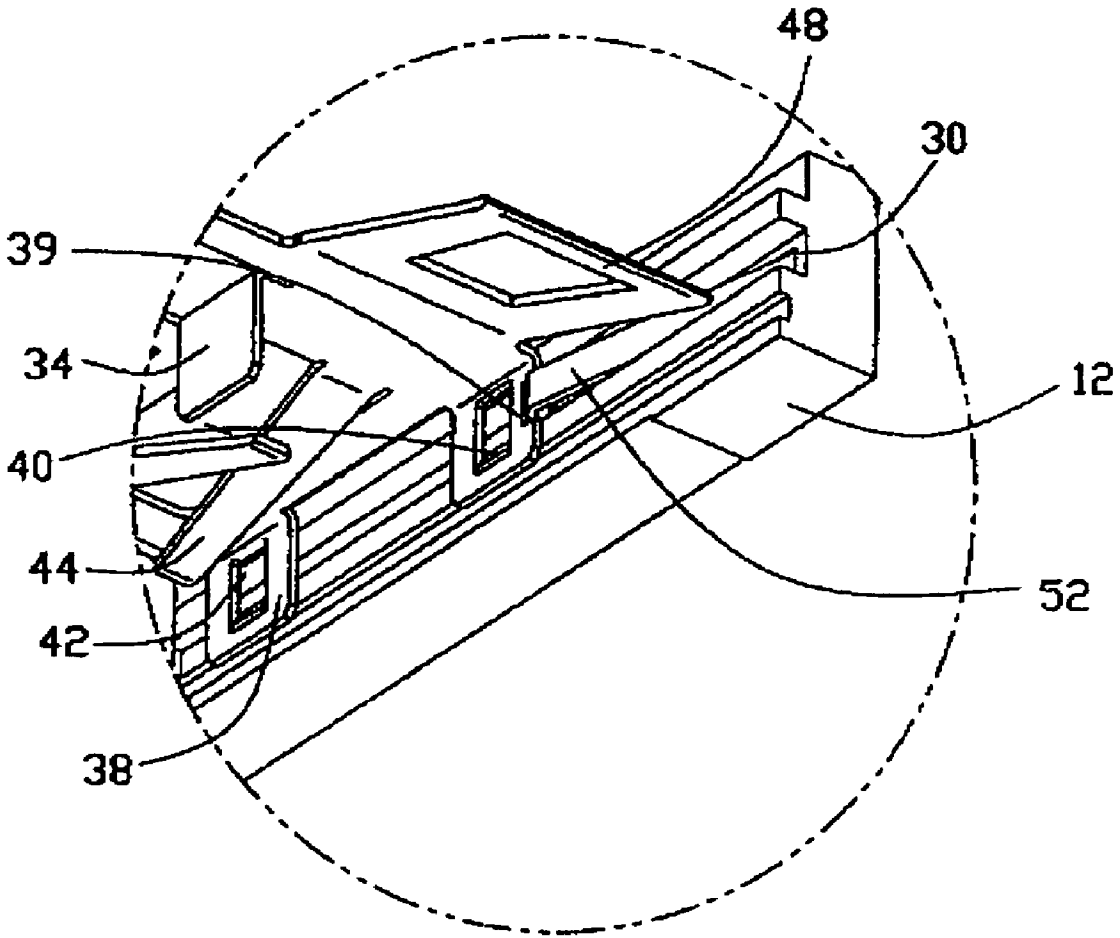
FIG. 7 is a partial enlarged perspective view of the connector of FIG. 6 to clearly show the engagement between the moveable plate and the stopper tang.
Figure 8:
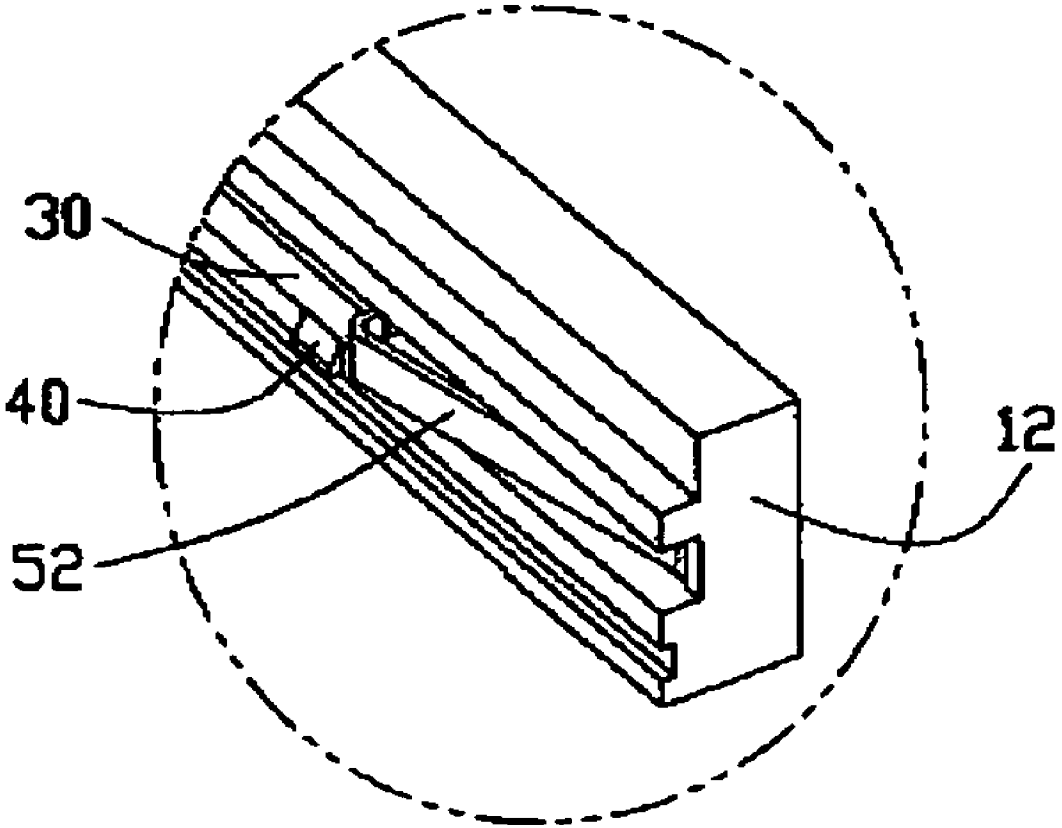
FIG. 8 is a partial enlarged perspective view of the connector of FIG. 1 to show how the stopper tang is located in a channel of the housing.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. As shown in FIGS. 1–4 and 12–14, an electrical card connector 1 includes an insulative housing 10 configured with a U-shaped configuration having a pair of side arms 12 connected by a rear bar 14. A plurality of first contacts 16 disposed in the rear bar 14 for being coupled to a first type card. A housing space 18 is formed among the pair of side arms 12 and the rear bar 14 and divided into a lower portion 20 to receive a contact module 22 which is equipped with a plurality of upwardly extending second contacts 24 and an upper portion 26 for receiving a large card 200 which is adapted to be coupled to the first contacts 16. The contact module 22 defines a shallow recess 28 for receiving a small card 100 which is adapted to be coupled to the second contacts 24. The side arm 12 forms a channel 30 therein for guidable insertion of the large card 200 into the upper portion 26.

Further referring to FIGS. 5–8 movable plate 32 is assembled to the housing 10 and includes a pair of vertical tabs 34 to be respectively received in the corresponding slits 36 in the contact module 22 for assuring vertical movement of the movable plate 32 relative to the housing 10 and the contact module 22. Two pairs of retention tabs 38 latchably engage the corresponding locking blocks 40 of the housing 10 adjacent to the corresponding side arms 12, respectively. Because there is a significant clearance between the opening 42 of the retention tab 38 and the corresponding block 40, the moveable plate 32 is moveable in a vertical direction within a range. Two pairs of spring tangs 44 are seated upon the base 23 of the contact module 22 so as to urge the moveable plate 32 upwardly. A plurality of openings 46 are formed in the moveable plate 32 for receive the upwardly extending second contacts 24 when the moveable plate 32 is downwardly pressed to be in a lower position for no interference. A pair of slanted guiding sections 48 extends forwardly adjacent to an entrance 50 of the housing 10.

Figure 9:
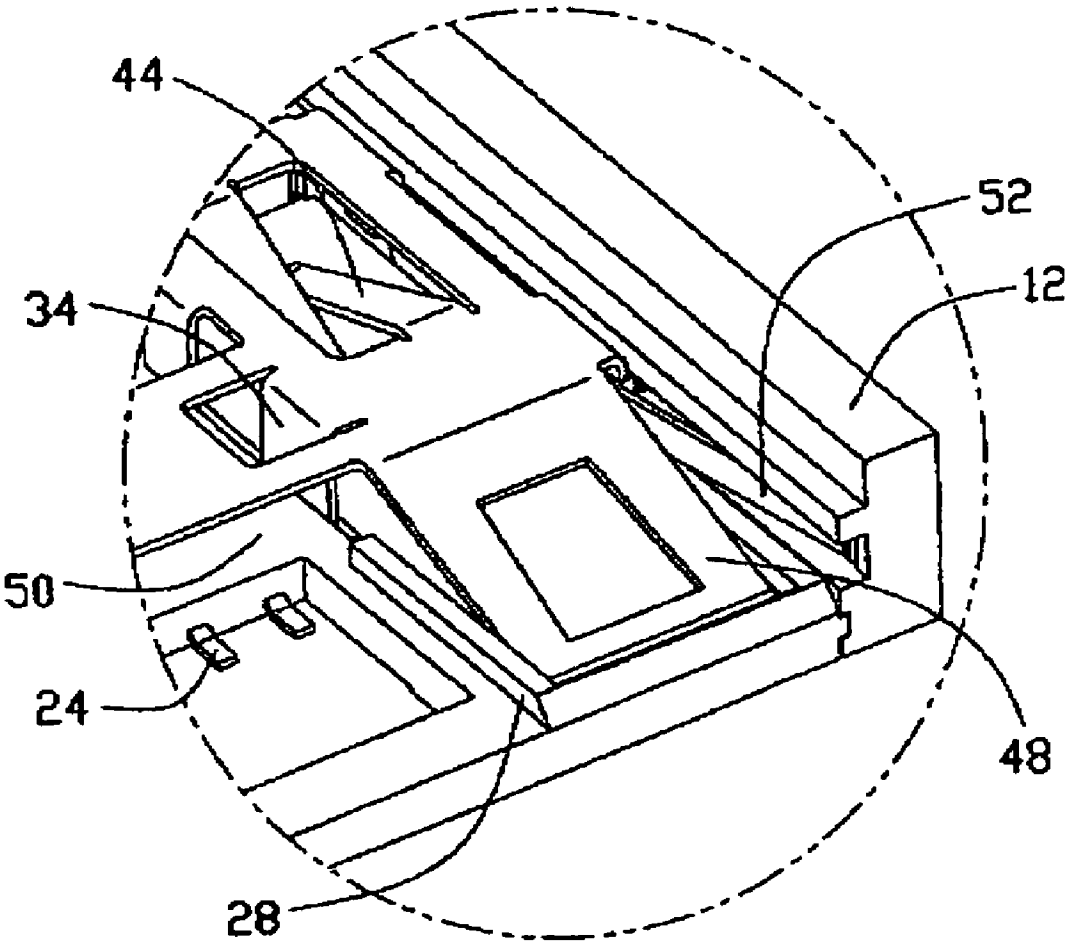
FIG. 9 is a partially enlarged perspective view of the connector of FIG. 1 to show the structural relation among the housing, the stopper tang, the contact module and the moveable plate.
Figure 10:
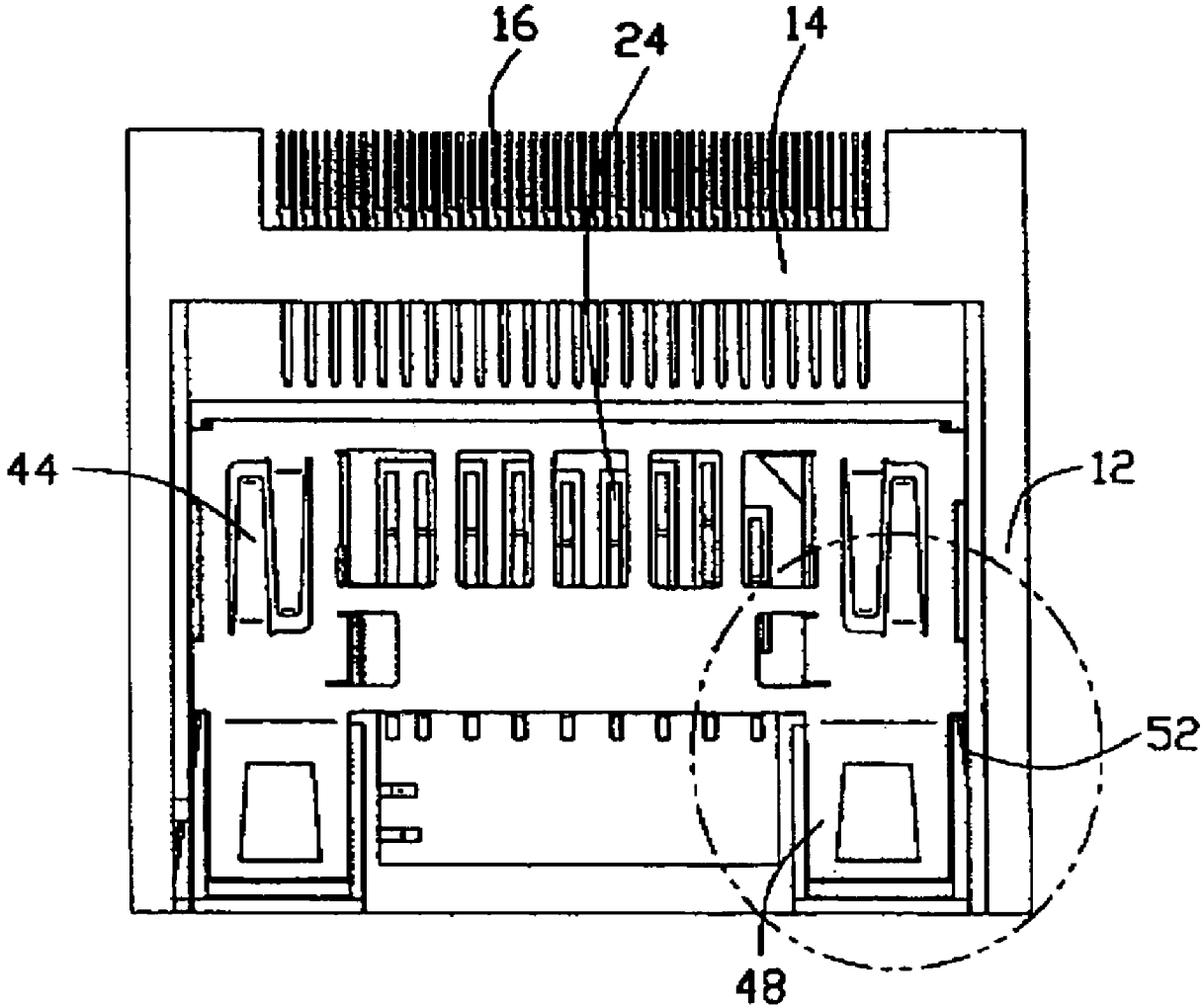
FIG. 10 is a top view of the connector of FIG. 1 to show the stopper tang invades the receiving space in a normal position.
Figure 11:
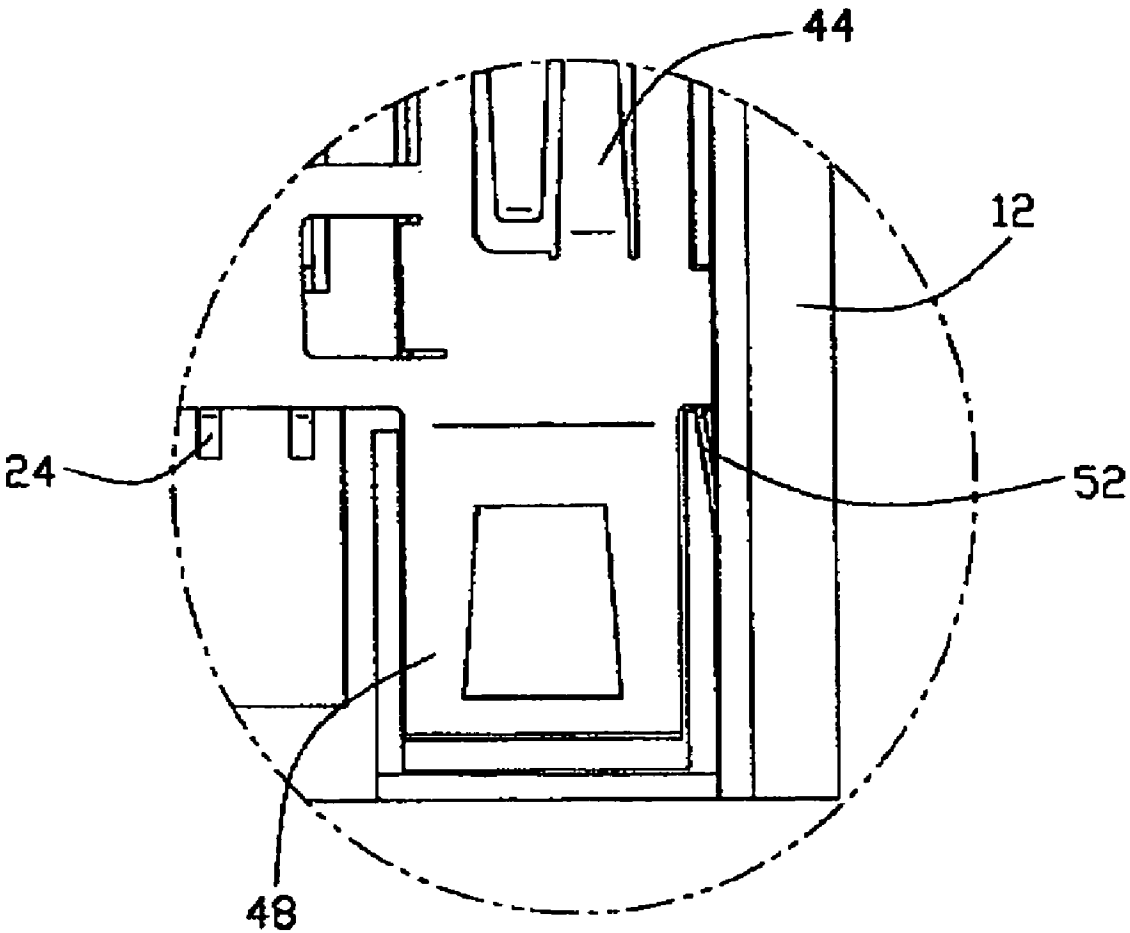
FIG. 11 is an partial enlarged top view to show how the stopper tang extends through the corresponding channel and further invades the receiving space while adapted to be received in the recess behind the channel.
Figure 12:
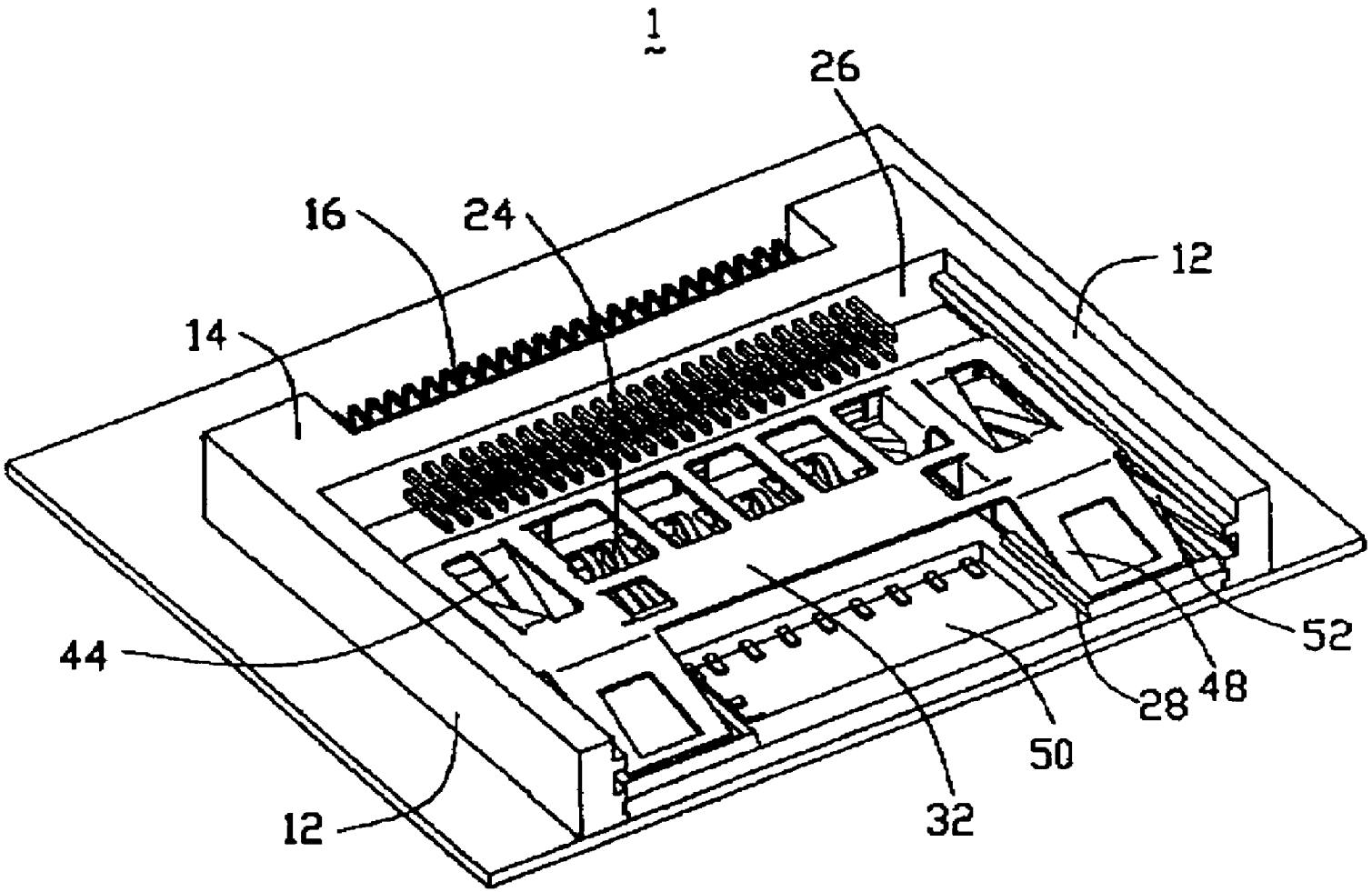
FIG. 12 is an assembled perspective view of the connector of FIG. 1 on a corresponding printed circuit board.
Figure 13:
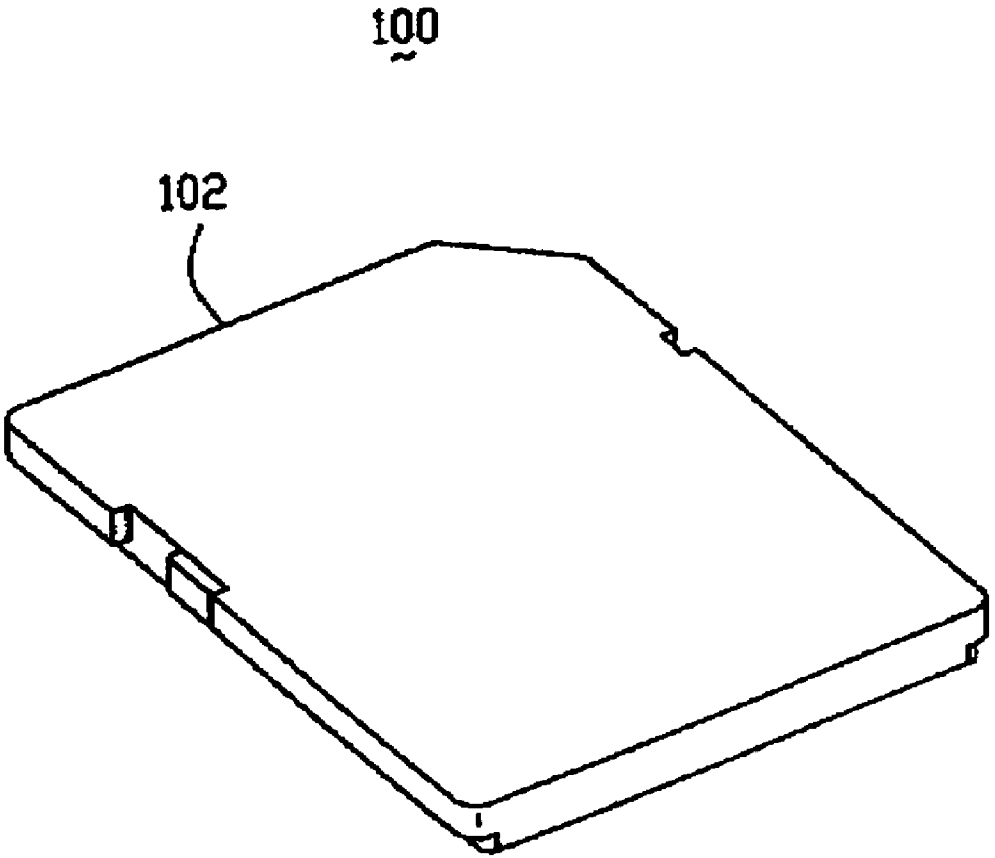
FIG. 13 is a perspective view of an IC card which is adapted to be received in a lower portion of the receiving space and engaged with the contact module.
Figure 14:
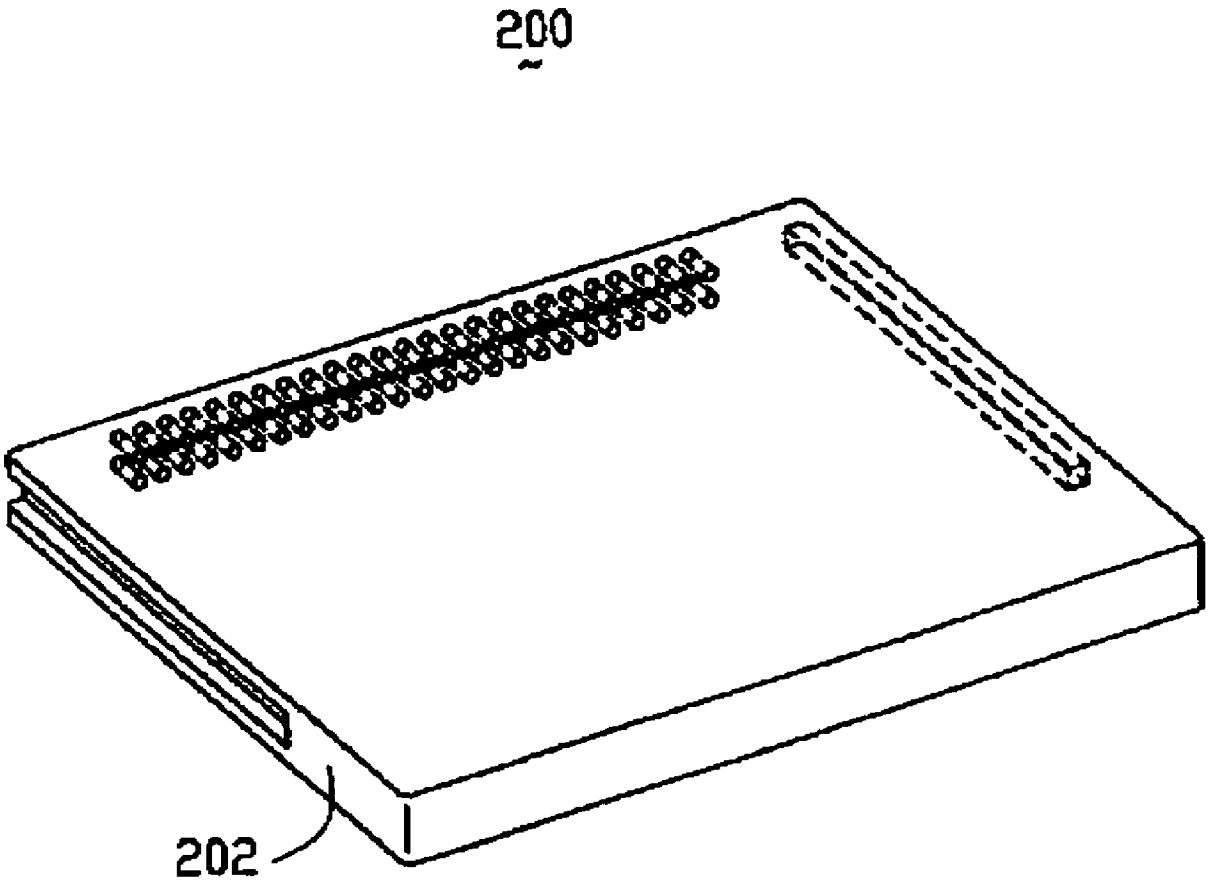
FIG. 14 is a perspective view of another type IC card which is adapted to be received in the lower portion of the receiving space and engaged with the contacts located in a rear portion of the housing.

Further referring to FIGS. 9–11, a stopper tang 52 is disposed in the channel 30 with a distal end further invading the housing space 18 to latchably engage a locking notch 39 formed in the retention tab 38 so as to restrain downward movement of the moveable plate 32.

The housing 10 defines a channel like structure in two side arms 12 to have the contact module 22 inserted into the lower portion 20 of the housing space 18 in a front-to-back direction. On the other hand, the retention tabs 38 are latchably received in the corresponding latching notches 21 formed in the contact module 22. Thus, the contact module 22 is immoveable relative to the housing 10.

When the large card 200 is inserted into the upper portion 26 via the same housing entrance 50 at the front end, two side edges 202 of the card 200 will first push the corresponding stopper tang 52 away from the housing space 18 and back to the corresponding channel 30. Under this condition, the corresponding locking notch 39 is released from the stopper tang 32, and the further rearward insertion of the card 200 is allowed to move along the guiding sections 48 and downwardly push the moveable plate 32 for fully inserting the card 200 into the housing space 18 until engaging the corresponding first contacts 16. In opposite, the small card 100 essentially can not actuate the stopper tang 32, and thus can not mistakenly reach the upper portion 26. It is noted that the base 23 of the contact module 22 defines some recessed area 25 in the upper face to receive the downward movement of the moveable plate 32. Accordingly, the large card 200 is supportably seated upon the moveable plate 32 and the base plane 11 of the housing 10.

On the other hand, the small card 100 can be inserted into the lower portion 20 via the same entrance 50 and laterally restrained between the a pair of guiding sections 48. The further insertion of the card 100 stops when the front edge of the card 102 confronts the rear wall 27 of the contact module 22. Under this condition, the card 100 is located between the moveable plate 32 and the base 23 of the contact module 22.

It is noted that some other type small cards have a greater thickness than the card 100, and under that situation, such other type small card may partially invade the upper portion 26.

It is noted that the moveable plate 32 functions not only the anti-mismating means for incorrect insertion but also the guiding means for correct insertion under a condition of the common entrance and even at least partially the common receiving space.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field are to understand that all such equivalent structures are to be included in the scope of the following claims.

I claim:

1. An electrical connector comprising:

an insulative housing defining a pair of side arms and a rear connection bar, a space defined among the pair of side arms and the rear connection bar, said space including a first portion and a second portion along a vertical direction for receiving a first card and a second card, respectively;

a plurality of first contacts disposed in the rear connection bar;

a plurality of second contacts disposed in the second portion;

a moveable plate up-and-down moveable in the housing;

a moveable stopper device located around the side arm to latch or unlatch said movable plate; wherein when the first card is inserted into the space, the stopper device will unlock the moveable plate to allow the moveable plate to move for not blocking full insertion of said first card into the first portion; when the second card is inserted into the space, the stopper device will lock the moveable plate so as to prevent said second card from insertion into the first portion but only being allowed to be inserted into the second portion.

2. The connector as defined in claim 1, wherein said first portion and said second portion share a same entrance at a front end of the housing.

3. The connector as defined in claim 1, wherein said moveable plate includes a pair of sections at a front portion for guiding the first card to the first portion and the second card to the second portion, respectively.

4. The connector as defined in claim 1, wherein said second contacts are provided by a contact module located in the second portion.

5. The connector as defined in claim 1, wherein said moveable plate is provided with spring tangs to urge said moveable plate in the first portion.

6. The connector as defined in claim 1, wherein said stopper device protrudes into the first portion in a normal condition so as to lock the moveable plate.

* * * * *